United States Patent [19]

Dennis et al.

[11] 3,978,443

[45] Aug. 31, 1976

[54] FUSIBLE RESISTOR

[75] Inventors: Colin Dennis, Great Yarmouth; Arthur Denys Holt, Near Great Yarmouth; Patrick William Henry Moore, Near Potter Heigham, all of England

[73] Assignee: Erie Electronics Limited, London, England

[22] Filed: Oct. 4, 1974

[21] Appl. No.: 512,064

[30] Foreign Application Priority Data

Oct. 5, 1973 United Kingdom ..... 46744/73

[52] U.S. Cl. ..... 338/309; 337/159; 337/297; 338/322; 338/334

[51] Int. Cl.[2] ..... H01C 1/14

[58] Field of Search ..... 338/308, 309, 334, 322; 337/297, 159

[56] References Cited

UNITED STATES PATENTS

| | | | |
|---|---|---|---|
| 2,730,598 | 1/1956 | Lytle | 338/308 |
| 2,921,257 | 1/1960 | Boicy | 338/309 X |
| 3,185,947 | 5/1965 | Freymodsson | 338/308 X |
| 3,441,804 | 4/1969 | Klemmer | 338/308 X |
| 3,555,485 | 1/1971 | Solow | 338/309 |
| 3,621,441 | 11/1971 | Hundall | 338/309 |
| 3,887,893 | 6/1975 | Brandt | 338/334 X |

*Primary Examiner*—E. A. Goldberg
*Attorney, Agent, or Firm*—Gifford, Chandler & Sheridan

[57] ABSTRACT

A fusible resistor has a substrate on which two terminal paths are formed. A resistor in the form of an area of resistive material deposited onto the substrate extends between the terminal paths. The expected line of fracture of the substrate, upon a current flowing through the resistor such that the rate wattage is exceeded, crosses at least one of the terminal paths. Desirably at least one line or zone of weakness is formed in the substrate.

10 Claims, 10 Drawing Figures

FUSIBLE RESISTOR

BACKGROUND OF THE INVENTION

1. Field of the Invention

This invention relates to fusible resistors.

2. Prior Art

In certain electrical and electronic circuits the failure of one component can cause a catastrophic failure of one or more other components. For example, an excessive current in a transistor in one part of the circuit can cause an excessive current to flow in one or more other parts of the circuit with the result that semiconductor devices suffer irreversible breakdown. Any protection device has to operate at a current level lower than the critical level and within a specified time and such a protective device has to either limit the current or cut it off. In order to cut off the current a conductive path has to be broken and this of course is the traditional function of a fuse.

As is known the effect of an excessive current (assuming a constant voltage) is to increase the heat dissipation and protective resistors using this effect have already been used. For example it is known to provide a protective resistor having a spring clip through which the current flows and which has one end soldered to the body of the resistor. When the heat dissipation in the resistor exceeds a critical value the temperature of the resistor rises above the melting point of the solder and the spring clip is released creating a break in the conducting path whereupon current ceases to flow.

It has also been proposed to provide a protective device in the form of a thick film resistor. In this proposal there is first screened on to a ceramic substrate two strips of relatively conductive material which strips can be considered as terminal strips. The substrate carrying the two terminal strips is then baked and fired at a high temperature whereafter relatively resistive material is screened on to the substrate so as to extend between the terminal strips and then the substrate with the resistive material on it is baked and fired.

In certain cases instead of screening a resistive material onto the substrate so as to extend between the terminal strips, the conductive material is screened on to the substrate so as to form a relatively long path between the terminal strips to provide a low value resistor; for this purpose the path of the conductive material between the terminal strips may be that of a zig-zag or any other meander path. Connections to the terminal strips are usually made by press-fitting tags onto the substrate which tags are then soldered to the conductive strips. In this way a thick film resistor is formed and the wattage rating of this resistor will depend on the area and thickness of the substrate, the amount of heat lost, in use, by conduction through the tags to, for example, printed circuit boards, and heat radiation and convection. When, however, the rated wattage is exceeded by a certain factor, the substrate is stressed by thermal expansion to the extent that it breaks. The thickness of the substrate is one of the factors controlling the time and wattage at which the break will occur.

SUMMARY OF THE PRESENT INVENTION

It is an object of this invention to provide an improved fusible resistor.

According to this invention there is provided a fusible resistor comprising a substrate, on which two terminal paths of conductive material are formed, and a resistor carried by the substrate and extending between the terminal paths, the resistor being such that the expected line of fracture of the substrate, upon a current flowing through the resistor such that the rated wattage is exceeded, crosses at least one of the terminal paths.

A fusible resistor in accordance with this invention alleviates the problem which exists with the previously proposed type of fusible resistor which has been described. With that type of fusible resistor although the substrate may break when the rated wattage is exceeded by a given factor there may still be a conducting path through the or part of the resistor. When the current passing through a fusible resistor in accordance with this invention is such that the specified wattage is exceeded it is to be expected that a fracture will occur along a path which crosses one of the terminal paths. With this arrangement it is less likely that a conductive path will remain through the fusible resistor after fracture has occurred.

It is preferred that the resistor carried by the substrate is in the form of an area of resistive material deposited onto the substrate and extending between the terminal paths. All materials have a resistivity and the significant difference between the conductive material of the terminal paths and the resistive material of the resistor formed on the substrate is that the resistivity of the conductive material of the terminal paths is very much lower than that of the resistive material which provides the resistor. However it is possible that the resistor comprises a meander path of the same material as the terminal paths deposited on the substrate and extending between the terminal paths.

Preferably the fusible resistor is preformed with a line or zone of weakness in the substrate. Preferably the expected path of fracture wholly or partially passes through the line or zone of weakness in the substrate.

It is preferred that the substrate is thinner along the line or zone of weakness.

Preferably the substrate is generally rectangular but any shape can be employed.

In one embodiment of this invention, termination tags are secured to a rectangular substrate at its opposed short edges and the terminal paths between which the area of resistive material extends are parallel to the long edges of the substrate, one terminal path extending from its end opposite one of the termination tags to that termination tag with a space between the said extension of the said one terminal path and its part to which the area of resistive material extends, the end of the other terminal path remote from the other termination tag being extended to reach the said other termination tag with a space between the extension of the said other terminal path and its path to which the area of resistive material extends.

In another embodiment of this invention, termination tags are secured to corresponding ends of the long edges of a rectangular substrate, the area of resistive material being formed adjacent to the other end of the substrate, the terminal paths being parallel to the long edges of the substrate, the end of each terminal path near to the said other end of the substrate being extended to the corresponding termination tag and so as to be spaced from its part to which the area of resistive material extends.

BRIEF DESCRIPTION OF THE DRAWINGS

Embodiments of this invention will now be described, by way of example only, with reference to the accompanying drawings of which.

DETAILED DESCRIPTION OF THE PREFERRED EMBODIMENT

Figure 1:
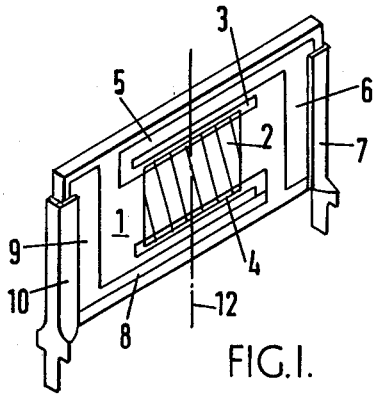
FIGS. 1 to 9 are each a perspective view of a fusible resistor in accordance with this invention.

Referring first to FIG. 1 a rectangular ceramic substrate 1 has formed on it a rectangular resistor 2 extending between parallel terminal paths 3 and 4 of conductive material.

In the attitude shown in FIG. 1 the lefthand end of the terminal path 3 is bent back over the top of the resistor 2 so as to extend parallel to the terminal paths 3 and 4 this portion of the terminal path being indicated at 5. The end of the terminal path 5 extends downwardly along the righthand edge of the substrate 1 as indicated at 6 and has crimped to it a terminal tag 7.

Similarly the terminal path 4 is bent back on itself so as to extend below the resistor 2 along a terminal path 8 parallel to the terminal path 3, 4 and 5; the terminal path 8 extends upwardly at the lefthand end of the substrate 1 as indicated at 9 and has crimped to it a further termination tag 10.

The substrate 1 is of a ceramic polycrystalline material, for example, alumina. However various other polycrystalline ceramics materials are suitable; glass is a suitable material. The material for forming the conductive paths 3, 5, 6, 4, 8 and 9 may be any of those typically used such as a palladium/silver or palladium/gold paste with the paste including glass frit. Other noble metals may be used but any material having suitable characteristics may be used; for example, materials utilizing base metals will also be suitable. Furthermore, the paste need not include glass frit.

The material of the resistor 2 may be any of those typically used, for example, ruthenium oxide paste based on a glass frit. Many other suitable materials using other noble metals are available currently; any material having suitable characteristics such as those utilising a base metal will also be suitable. Carbon, carbon pastes, metal oxides and metal oxide pastes are also suitable. Again the paste need not include glass frit.

One method of production of the fusible arrangement shown in FIG. 1 is to mold powder ceramic material in a die and then to fire it when grain growth occurs to form a polycrystalline material. During the heat treatment grain changes occur. The terminal paths of conductive material are then applied to the substrate 1 by screening, the substrate 1 then being baked and fired. Thereafter the resistive material forming the resistor 2 is screened onto the substrate so as to partially cover the terminal paths 3 and 4 and the substrate is subjected to baking and firing. Certain resistive materials do not require firing. The termination tags 7 and 10 are then crimped on to the substrate and soldered to the areas 6 and 9. Other modes of deposition including vacuum and chemical techniques and sputtering or spraying could be used. Also the substrate could be formed by a cast film process and may not be fired before screening.

An insulating material is then applied to the fusible resistor for a purpose which will be described later and may not necessarily cover the entire fusible resistor again for reasons which will be explained later.

In use, any current passing through the fusible resistor causes heating which induces a thermal stress in the substrate 1. Provided however that the current is below a critical value the heat dissipation is not sufficient to cause fracture. When however the current level exceeds the critical value the heat stress induced in the substrate is sufficient to cause fracture which is expected to occur at least partly along or near to an imaginary line 12 midway between the narrow sides of the substrate 1 and parallel thereto. Upon fracture occurring at least partly along or near this line the conductive path through the fusible resistor is broken firstly because the resistor 2 is fractured but mainly because the conductive paths 5 and 8 cross the line of fracture.

The termination tags 7 and 10 are inserted in normal use into apertures in a printed circuit board so that the printed circuit board tends to hold the fusible resistor together after fracture has occurred. Nevertheless because the line of fracture 12 crosses the terminal paths 5 and 8 and because any current passing through the fusible resistor must flow through the paths 5 and 8 a satisfactory break of the circuit normally occurs.

Typical dimensions of the substrate are 1 inch × ½ inch.

Figure 2:
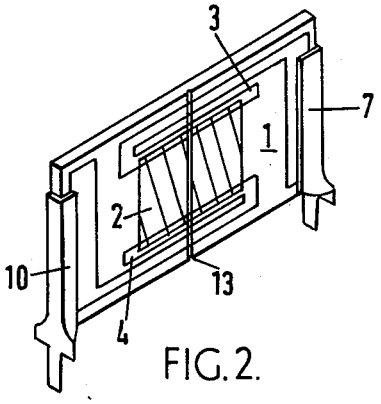

The arrangement shown in FIG. 2 is similar to that shown in FIG. 1 with the difference being that the substrate 1 is formed with a score line 13 along the expected line of fracture 12. The score line 13 does of course reduce the thickness of the substrate and creates a zone of weakness. With this arrangement the time taken for fracture to occur once the rated wattage has been exceeded is substantially reduced. The groove 13 may typically have a maximum width of 0.2 mm and an included angle of 68°.

Figure 3:
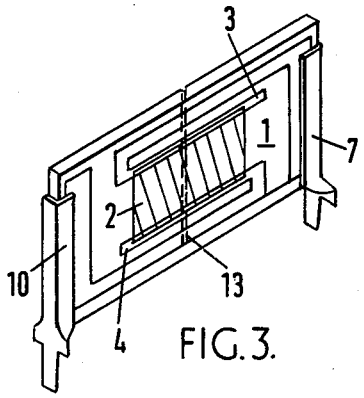

The arrangement shown in FIG. 3 only differs from that shown in FIG. 2 in that the score line 13 is formed on the opposite surface of the substrate 1 to that on which the terminal paths and the resistor 2 are formed. In practice, the fusible resistor shown in FIG. 3 will normally fracture more rapidly than that shown in FIG. 1 but less rapidly than that shown in FIG. 2.

The score line 13 may be formed by providing a die such that a V-shaped groove is formed in the substrate in the appropriate position; after molding the grooved substrate is fired. An alternative method of producing the score line 13 is to scribe the substrate before or after it has been formed with a cutting stylus; further alternatives are drilling a series of holes with a laser or by other means before or after firing, and air abrading.

As mentioned above the fusible resistor is partially covered with an insulating material the purpose of this being to prevent solder adhering to the resistor when its termination tags 7 and 10 are soldered during assembly. Such solder has a tendency to mechanically hold the substrate together even after fracture has occurred due to thermal stress. If lacquer is used as the insulating material it is arranged in parallel strips covering the paths 5, 3, 4 and 8 but it is ensured that these strips are not contiguous and it will of course be appreciated that the strips do not cover the whole of the short length of terminal paths connecting the lefthand ends of the strips 3 and 5 or short length terminal paths connecting the righthand ends of the terminal paths 4 and 8.

This feature has been introduced for the following reason. When a resistor is subjected to a wattage exceeding the rated value considerable heat is transferred to the lacquer which is an organic material and may carbonise to produce a film which is somewhat conductive. If the strips of lacquer were contiguous there might be a continuous conductive path from one terminal tag 7 to the other termination tag 10 partly through the terminal paths and the resistor 2 and partly through the carbonised lacquer. If this occurred a conductive path might exist after fracture.

The insulating material could be a glass.

Figure 4:
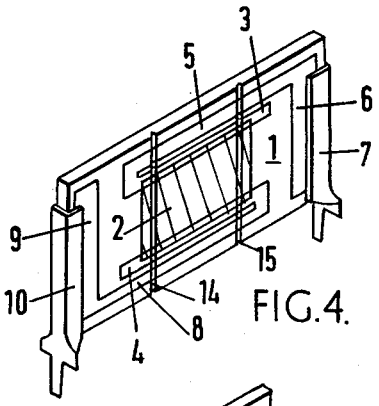
Figure 5:
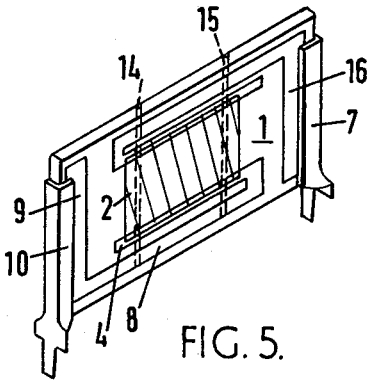

FIG. 4 shows a fusible resistor generally similar to that shown in FIG. 2 the difference being that it has two score lines 14 and 15 on opposite sides of the line 12 along or near which fracture would take place were there to be no score lines 14 and 15. The score lines 14 and 15 do of course cross the terminal paths 5, 3, 4 and 8. When the fusible resistor shown in FIG. 4 is subjected to a wattage exceeding the rated value, fracture at least partially occurs along one or both lines 14 and 15. The fusible resistor shown in FIG. 5 only differs from that shown in FIG. 4 in that the score lines 14 and 15 are formed on the opposite surface of the substrate 1 that is to say on the surface on which the resistive and conductive materials are not deposited.

The tags 7 and 10 could be of spring material and arranged to be stressed when inserted into a printed circuit board so that on fracture of the substrate the spring forces cause clear separation of the two parts of the substrate. This applies to FIGS. 1 to 5.

Figure 6:
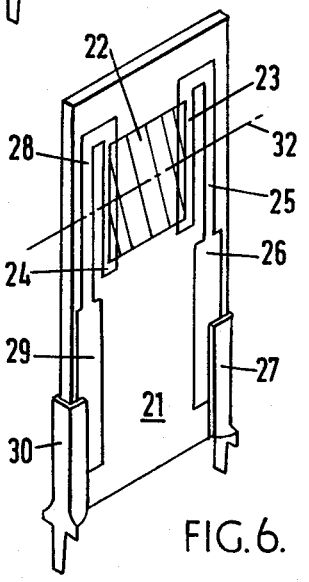

Referring now to FIG. 6 this shows a fusible resistor having a substrate 21 on which there is formed a rectangular resistor 22 consisting of resistive material deposited onto the substrate 21 and extending between vertical terminal paths 23 and 24. As can be seen in FIG. 6 the resistor 22 is formed towards one of the narrower ends of the substrate 21 the end being the upper end as shown in FIG. 6. The upper ends of the terminal paths 23 and 24 are bent back on themselves to form terminal paths 25 and 28 parallel to the paths 23 and 24 and continue into widened portions 26 and 29 respectively. To the widened portions 26 and 29 there are crimped and soldered termination tags 27 and 30 respectively. It will be seen that the components 1 to 10 of FIG. 1 correspond to components 21 to 30 of FIG. 6 respectively and that the terminations 27 and 30 are secured to the longer sides of the substrate 21 at the end opposite the resistor 22.

The fusible resistor shown in FIG. 6 is manufactured in a manner analogous to the manufacture of the fusible resistor shown in FIG. 1 and this method of manufacture will not be described in detail; similar materials may be used. The dimension may be 1.35 inches × 0.6 inches.

In use, when the actual wattage exceeds the rated value by a given factor the thermal stresses set up in the substrate 21 are sufficient to cause fracture at least partially along or near a line 32 parallel to the short side of the substrate 21 and extending approximately along a line half way up the resistor 22 in the orientation shown in the drawing. When fracture occurs the line of fracture crosses the terminal paths 28 and 25 ensuring a break in the current path and in practice what happens is that the entire part of the substrate 21 above the line 32 flies off because there is no force tending to keep it in position in contrast to the fusible resistors of FIGS. 1 to 5.

Figure 7:
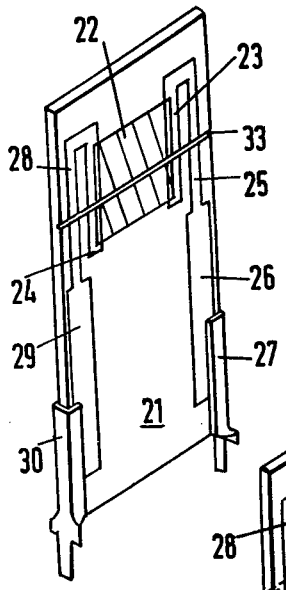
Figure 8:
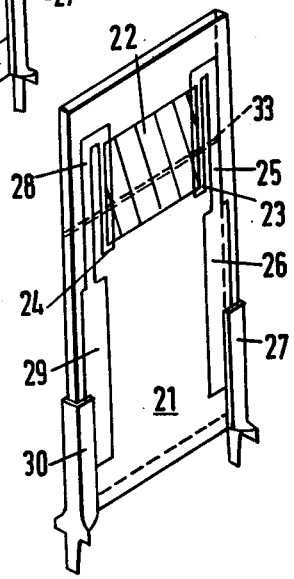

FIGS. 7 and 8 are similar to FIG. 6 except that a score line 33 is formed along the line 32 on the front and on the back of the substrate respectively (line 32 is only shown in FIG. 6).

The groove 33 may typically have a maximum width of 0.4 mm with an included angle of 68°.

Figure 9:
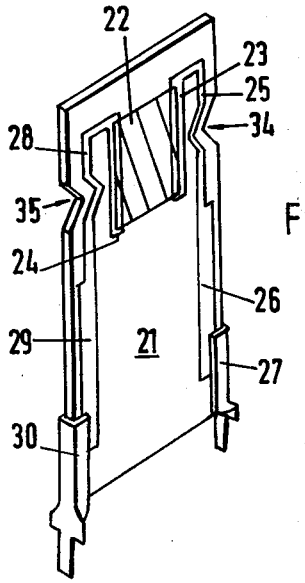

FIG. 9 shows a fusible resistor generally similar to that of FIG. 6 except that notches 34 and 35 are formed in the edges of the substrate 21 along the line of expected fracture. It is therefore necessary that the terminal paths 25 and 28 are not straight so that they go around the notches 34 and 35. With this arrangement there is effectively formed a line of weakness along the line 32 and this fusiblle resistor operates in practice in the sam way as the fusible resistor shown in FIG. 7.

The value of each of the described resistors can be adjusted by removing some of the resistive material by an air blast containing abrasive material, or by the use of a laser or cutting wheel.

Figure 10:
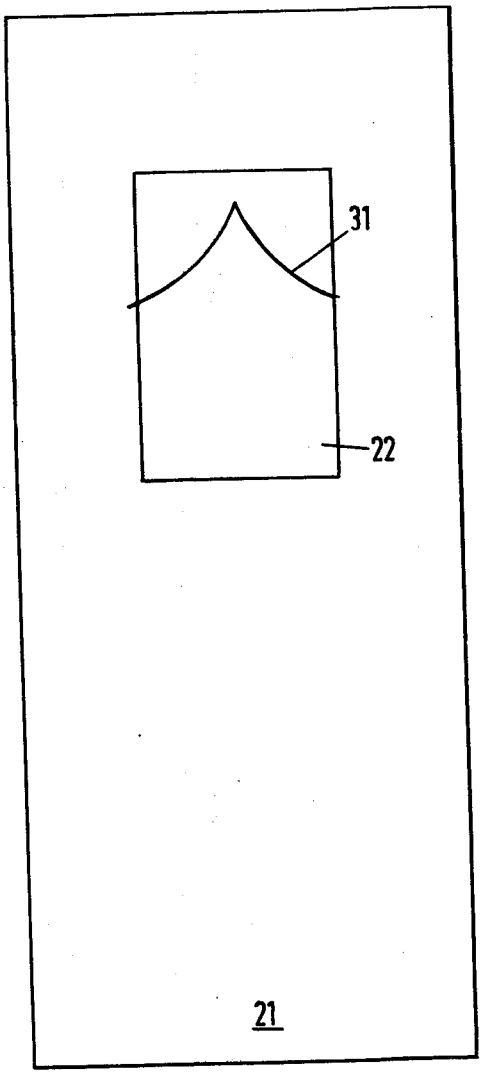
FIG. 10 is a drawing illustrative of the mode of operation of each of the embodiments of FIGS. 6 to 9.

FIG. 10 shows the substrate of FIGS. 6 to 8 to a larger scale and showing only the resistor 22. It is considered that line 31 denotes the line of maximum thermal stress and it has been found in practice that fracture tends to occur at least partly along the line 31.

It is possible to produce by alternative methods a zone or zones of high thermal stress in which case no groove will normally be provided.

The range of values of the resistors for each of the embodiments shown in FIGS. 1 to 9 may typically be 0.22 ohms to 10 Megohms.

The time taken for fracture to occur may be illustrated by the following typical example. Assuming the rated value for each of the three embodiments illustrated in FIGS. 6 to 8 is 3 watts the break time at 5 times related wattage i.e. 15 watts was in the case of the embodiment illustrated in FIG. 6, 20 seconds (typical average), in the case of the embodiment illustrated in FIG. 8, 10 seconds (typical average) and in the case of the embodiment illustrated in FIG. 7, 7 seconds (typical average).

The tags illustrated could be replaced by wires or terminating areas only may be provided for plugging or soldering into printed circuit boards or connectors.

We claim:

1. A fuse comprising a substrate, two terminal paths of conductive material formed on said substrate, and a resistor carried by said substrate and extending between said terminal paths, said resistor constructed to form a line of maximum thermal stress in said substrate upon a current passing through said resistor which line of maximum thermal stress in turn defines an expected line of fracture of said substrate such that the substrate fractures nearly along said expected line of fracture when the rated wattage for the fuse is exceeded, wherein at least one of said terminal paths includes a first portion adjacent and contacting said resistor and a second portion spaced from said first portion so that an area of the substrate separates said first and second portions of said terminal path, and wherein said expected line of fracture respectively crosses said first portion of said last mentioned terminal path, said area of said substrate and said second portion of said last mentioned terminal path.

2. The fuse as defined in claim 1 wherein the resistor carried by the substrate is in the form of an area of resistive material deposited onto the substrate and extending between the terminal paths.

3. The fuse as defined in claim 1 which is formed with a zone of weakness in the substrate.

4. The fuse as defined in claim 3 wherein the zone of weakness is provided by a groove.

5. The fuse as defined in claim 4 wherein the resistor carried by the substrate is in the form of an area of resistive material deposited onto the substrate and extending between the terminal paths and wherein the groove is on the side of the substrate on which the area of resistive material is deposited.

6. The fuse as defined in claim 4 wherein the resistor carried by the substrate is in the form of an area of resistive material deposited onto the substrate and extending between the terminal paths and wherein the groove is on the opposite side of the substrate to that on which the area of resistive material is deposited.

7. The fuse as defined in claim 3 wherein the zone of weakness is formed by a notch in at least one edge of the substrate to which the zone extends.

8. The fuse as defined in claim 3 wherein the expected path of fracture passes at least partially along through the zone of weakness in the substrate.

9. The fuse as defined in claim 2 wherein the substrate is generally rectangular and wherein termination tags are secured to corresponding ends of the long edges of the substrate, the area of resistive material being formed adjacent to the other end of the substrate, the terminal paths being parallel to the long edges of the substrate, the end of each terminal path near to the said other end of the substrate being extended to the corresponding termination tag and so as to be spaced from it portion to which the area of resistive material extends.

10. A fuse as defined in claim 2 wherein the substrate is generally rectangular and wherein termination tags are secured to the substrate at its opposed short edges and wherein the first and second portions of at least one of said terminal paths are parallel to the long edges of the substrate, said second portion of said last mentioned terminal path extending from one of the termination tags along one long edge of said substrate, wherein said last mentioned terminal path includes a portion connecting the ends of the first and second portions of said last mentioned terminal path most remote from said last mentioned termination tag.

* * * * *